US006663351B2

(12) United States Patent
Joo

(10) Patent No.: US 6,663,351 B2
(45) Date of Patent: Dec. 16, 2003

(54) PIEZOELECTRIC ACTUATED ELASTIC MEMBRANE FOR A COMPRESSOR AND METHOD FOR CONTROLLING THE SAME

(75) Inventor: Jae-Man Joo, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 75 days.

(21) Appl. No.: 10/073,218

(22) Filed: Feb. 13, 2002

(65) Prior Publication Data

US 2002/0131868 A1 Sep. 19, 2002

(30) Foreign Application Priority Data

Mar. 15, 2001 (KR) ..... 2001-13300
Jan. 29, 2002 (KR) ..... 2002-5068

(51) Int. Cl.[7] ..... F04B 17/04

(52) U.S. Cl. ..... 417/53; 417/417; 417/410.1; 417/902; 62/6

(58) Field of Search ..... 417/53, 417, 410.1, 417/902, 415, 416; 62/6

(56) References Cited

U.S. PATENT DOCUMENTS 5,067,684 A * 11/1991 Garnjost ..... 248/550
5,177,971 A * 1/1993 Kiyota ..... 62/6
5,255,521 A * 10/1993 Watanabe ..... 62/6
5,531,074 A * 7/1996 Katagiri et al. ..... 62/6
5,607,292 A * 3/1997 Rao ..... 417/417
5,769,608 A * 6/1998 Seale ..... 417/416
6,004,115 A * 12/1999 da Costa ..... 417/413.2
6,273,688 B1 8/2001 Kawahara et al.
6,514,047 B2 * 2/2003 Burr et al. ..... 417/415

* cited by examiner

*Primary Examiner*—Cheryl J. Tyler
(74) *Attorney, Agent, or Firm*—Staas & Halsey LLP

(57) ABSTRACT

A compressor includes a cylinder block having a compression chamber therein, a piston arranged in the compression chamber which reciprocates up and down, and a driving mechanism which drives the piston. The driving mechanism includes an elastic member whose peripheral portions are fixed to the cylinder block so as to allow the elastic member to oscillate up and down, and whose center portion is attached to the piston, and one or more piezoelectric actuators that are arranged on the elastic member. In response to a power, one or more piezoelectric actuators repeatedly deform and apply an exciting power to the elastic member.

38 Claims, 9 Drawing Sheets

PIEZOELECTRIC ACTUATED ELASTIC MEMBRANE FOR A COMPRESSOR AND METHOD FOR CONTROLLING THE SAME

CROSS-REFERENCE TO RELATED APPLICATIONS

This application claims the benefit of Korean Application Nos. 2001-13300, filed Mar. 15, 2001 and 2002-5068, filed Jan. 29, 2002, in the Korean Industrial Property Office, the disclosures of which are incorporated herein by reference.

BACKGROUND OF THE INVENTION

1. Field of the Invention

The present invention relates to compressors, and more particularly, to a compressor having a driving mechanism for linearly reciprocating a piston and a method for controlling the same.

2. Description of the Prior Art

In general, compressors are used to suck, compress and discharge a gas such as a vaporized refrigerant in apparatuses utilizing a refrigeration cycle, such as refrigerators and air conditioners. The compressors can be classified into linear compressors, reciprocating compressors, and rotary compressors. The linear compressors equipped with linear motors as their driving mechanisms have relatively high energy efficiencies due to a low energy loss in their driving mechanisms.

FIG. 1 shows the interior construction of a conventional linear compressor. The conventional linear compressor comprises a driving mechanism 3 which generates power in an airtight container 1 and a compressing mechanism 2 which sucks and compresses a refrigerant using the power transmitted from the driving mechanism 3.

The compressing mechanism 2 includes a cylinder block 2*b* provided with a compression chamber 2*a* therein, and a cylinder head 2*c* coupled to the upper portion of the cylinder block 2*b* so as to guide the refrigerant being sucked and discharged. Additionally, a piston 2*d* which linearly reciprocates in response to an operation of the driving mechanism 3 is arranged in the compression chamber 2*a*.

The driving mechanism 3, which is a kind of a linear motor, includes a tubular back iron 3*d* arranged outside of the cylinder block 2*b*, a core 3*b* spaced apart from the tubular back iron 3*d* having a wound coil 3*a* which forms a magnetic field in response to an applied power, and a magnet 3*c* arranged between the core 3*b* and the tubular back iron 3*d* which moves up and down.

The core 3*b* is composed of a plurality of layered electrical steel sheets, whose upper and lower portions are supported by a first frame 2*e* which outwardly extends from the upper portion of the cylinder block 2*b* and a second frame 2*f* fixed to the first frame 2*e* by bolts 4, respectively. The magnet 3*c* linearly reciprocates through interaction with the magnetic field formed by the core 3*b*, and is connected to the piston 2*d* through a connection rod 5. The piston 2*d* reciprocates in the compression chamber 2*a* by the reciprocating movement of the magnet 3*c*.

The compressing mechanism 2 and the driving mechanism 3 are supported by coil springs 6 and a resonance spring 7 that elastically support the cylinder block 2*b* in the lower portion of the interior of the airtight container 1. That is, the coil springs 6 which elastically support the cylinder block 2*b* in the lower portion of the interior of the airtight container 1 are arranged under spacers 8 placed under the second frame 2*f* so as to position the piston 2*d*.

The resonance spring 7 is a kind of a leaf spring, whose peripheral portions are attached to the spacers 8 and whose center portion is connected to the piston 2*d*. The resonance spring 7 enhances the power to reciprocate the piston 2*d* and oscillates with the piston 2*d* in upward and downward directions (directions indicated by the arrows of FIG. 1).

However, the driving mechanism 3 which linearly reciprocates the piston 2*d* comprises a linear motor that requires a considerable-sized core and magnet to obtain a desired output. Furthermore, the structure of the linear motor is complicated.

Accordingly, the overall size of the conventional linear compressor is large and hinders the compressor from being mounted within apparatuses such as refrigerators. Additionally, the manufacturing process of a driving mechanism for a conventional linear compressor is complicated, making the performance of the compressor dependent on the complicated manufacturing process of the driving mechanism.

In addition, the piston 2*d* of the conventional linear compressor is operated to desired displacements by phase-controlling the driving mechanism 3 comprises a linear motor. For such an operation, the linear motor requires additional displacement sensors (not shown) to sense the displacements of the magnet 3*c* and the piston 2*d*. As a result, the linear compressor is problematic in that other portions of the compressor are restricted to a narrow installation space due to the displacement sensors being mounted in the airtight container 1. Moreover, the displacement sensors may undergo an integer variation due to temperature, and it is difficult to control the integer variation.

SUMMARY OF THE INVENTION

Accordingly, it is an object of the present invention to provide a compressor with an improved driving mechanism which linearly operates a piston, and allows the compressor to be miniaturized and easily manufactured.

It is another object of the present invention to provide a method of controlling a compressor provided with an improved driving mechanism for linearly operating a piston, which is capable of allowing the driving mechanism to be easily controlled.

Additional objects and advantages of the invention will be set forth in part in the description which follows and, in part, will be obvious from the description, or may be learned by practice of the invention.

To achieve the above and other objects of the present invention there is provided a compressor comprising a cylinder block having a compression chamber, a piston arranged in the compression chamber which reciprocates up and down, and a driving mechanism which drives the piston and comprises an elastic member whose peripheral portions are fixed to the cylinder block so as to allow the elastic member to oscillate up and down and whose center portion is attached to the piston, and one or more piezoelectric actuators arranged on the elastic member which repeatedly deform in response to a power and apply an exciting power to the elastic member.

To achieve the above and other objects of the present invention there is provided a method of controlling a compressor comprising a cylinder block having a compression chamber, a piston positioned in the compression chamber which reciprocates up and down through the compression chamber, an elastic member whose peripheral portions are fixed to the cylinder block so as to allow the elastic member to oscillate up and down and whose center portion is attached to the piston, and one or more piezoelectric actuators arranged on the elastic member which repeatedly deform in response to a power and apply an exciting power to the elastic member, the method comprising sensing a displacement of the elastic member through deformations of the piezoelectric actuators and controlling the displacement of the elastic member by adjusting an amount and/or frequency of an electric voltage applied to the piezoelectric actuators.

BRIEF DESCRIPTION OF THE DRAWINGS

The above objects, features and advantages of the present invention will become more apparent by describing in detail preferred embodiments thereof with reference to the attached drawings in which.

DESCRIPTION OF THE PREFERRED EMBODIMENTS

Figure 1:
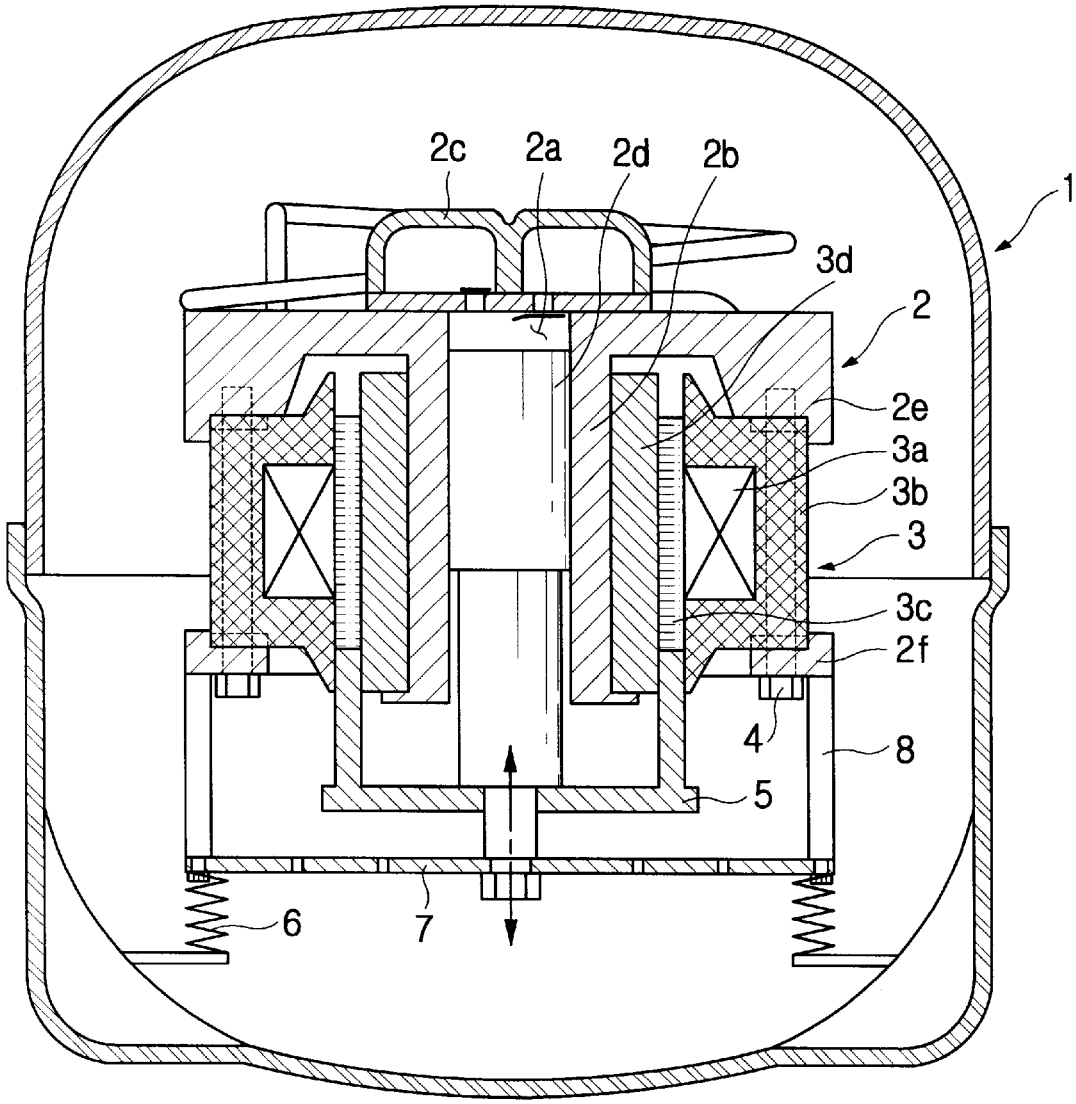
FIG. 1 (PRIOR ART)
FIG. 1 is a sectional view showing the interior construction of a conventional linear compressor.

Reference will now be made in detail to the present preferred embodiments of the present invention, examples of which are illustrated in the accompanying drawings, wherein like reference numerals to like elements throughout.

Figure 2:
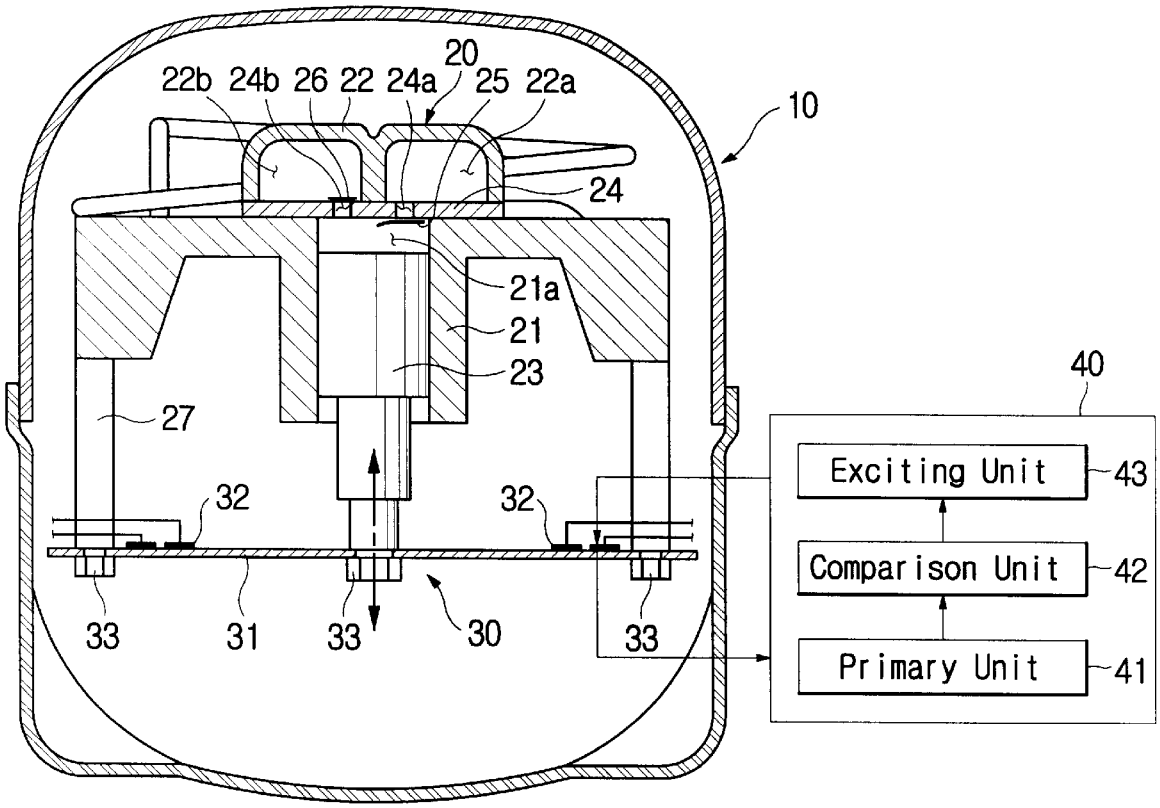
FIG. 2 is a sectional view showing the interior construction of a compressor according to an embodiment of the present invention.

FIG. 2 shows the interior construction of a compressor according to an embodiment of the present invention. As shown in FIG. 2, the compressor of the present invention includes a compressing mechanism 20, a driving mechanism 30, and an airtight container 10. The compressing mechanism 20 sucks a refrigerant (not shown) completely evaporated in a refrigeration cycle, forming a closed circuit, and compresses and discharges the sucked refrigerant. The driving mechanism 30 generates a driving power with electricity supplied from the outside. The airtight container 10 encloses the driving mechanism 30 and the compressing mechanism 20 therein.

The compressing mechanism 20 is arranged in an upper portion of the interior of the airtight container 10. The compressing mechanism includes a cylinder block 21 having a compression chamber 21*a*, and a cylinder head 22 arranged on the top of the cylinder block 21 which guides the refrigerant being sucked and discharged. The compression chamber 21*a* is axially formed through the cylinder block 21. A piston 23, which reciprocates up and down by the driving mechanism 30, is arranged in the compression chamber 21*a*. The cylinder head 22 is provided therein with a suction chamber 22*a* which guides the refrigerant being sucked into the compression chamber 21*a*, and a discharge chamber 22*b* which accommodates the refrigerant discharged from the compression chamber 21*a*. Additionally, a valve plate 24, a suction valve 25 and a discharge valve 26 are arranged between the cylinder head 22 and the cylinder block 21. A suction hole 24*a* and a discharge hole 24*b* are formed through the valve plate 24. The suction valve 25 and the discharge valve 26 selectively open and close the suction hole 24*a* and the discharge hole 24*b*, respectively, according to upward and downward movements of the piston 23. While the piston 23 moves toward its bottom dead center, the suction valve 25 is opened and the refrigerant in the suction chamber 22*a* is sucked into the compression chamber 21*a* through the suction hole 24*a*. On the other hand, while the piston 23 moves toward its top dead center, the discharge valve 26 is opened and the refrigerant in the compression chamber 21*a* is compressed and discharged to the discharge chamber 22*b* through the discharge hole 24*b*.

The driving mechanism 30, which reciprocates the piston 23 up and down, comprises an elastic member 31 and one or more of piezoelectric actuators 32. The driving mechanism 30 of the present invention has a simpler construction and can easily be miniaturized as compared to the conventional driving mechanisms shown in FIG. 1. In the present embodiment, peripheral portions of the elastic member 31 are connected to the cylinder block 21, and a center portion of the elastic member 31 supports the piston 23. The piezoelectric actuators 32 are used to oscillate the elastic member 31 up and down.

Figure 3:
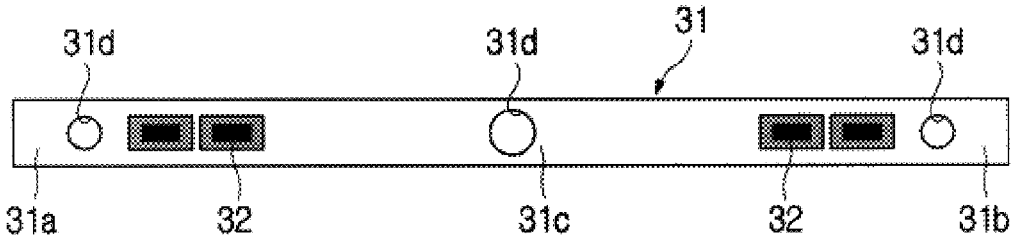
FIG. 3 is a plan view showing an elastic member of the compressor shown in FIG. 2 according to an aspect of the present invention.

FIG. 3 shows the construction of the driving mechanism 30. Referring to FIGS. 2 and 3, the elastic member 31 comprises a leaf spring. Two peripheral portions 31*a* and 31*b* of the elastic member 31 are fixed by fastening means such as bolts 33 to a pair of fixing members 27 downwardly extended from both sides of the cylinder block 21. A center portion 31*c* of the elastic member 31 is fixed to a bottom of the piston 23 also by fastening means such as the bolt 33. Fixing holes 31*d* are formed through the peripheral portions 31*a* and 31*b* and the center portion 31*c* of the elastic member 31 so as to accommodate the bolts 33 therein. The elastic member 31, fixed to the piston 23, oscillates up and down in response to an operation of the piezoelectric actuators 32.

As a positive voltage and a negative voltage are alternately applied to the piezoelectric actuators 32, the piezoelectric actuators 32 repeatedly deform up and down, resulting in an exciting force applied to the elastic member 31. In response to the exciting force, the elastic member 31 oscillates up and down.

According to an embodiment of the present invention, the piezoelectric actuators 32 are attached to the peripheral portions 31*a* and 31*b* of an upper surface of the elastic member 31, on the opposite sides of the piston 23. The piezoelectric actuators 32 include intelligent type elements, such as piezoelectric elements, piezoelectric ceramics and shape memory alloys, which oscillate the elastic member 31 and sense the position of the elastic member 31. In response to an electrical energy, the intelligent type elements convert the applied electrical energy into a mechanical quantity, such as a force or a deformation. In response to a physical force, the intelligent type elements convert the physical force into a converted electrical energy.

According to an aspect of the present invention, piezoelectric elements are implemented as the piezoelectric actuators 32.

According to another aspect of the present invention, a controller 40 is constructed to sense the displacement of the elastic member 31 by using deformations of the piezoelectric elements.

Figure 4:
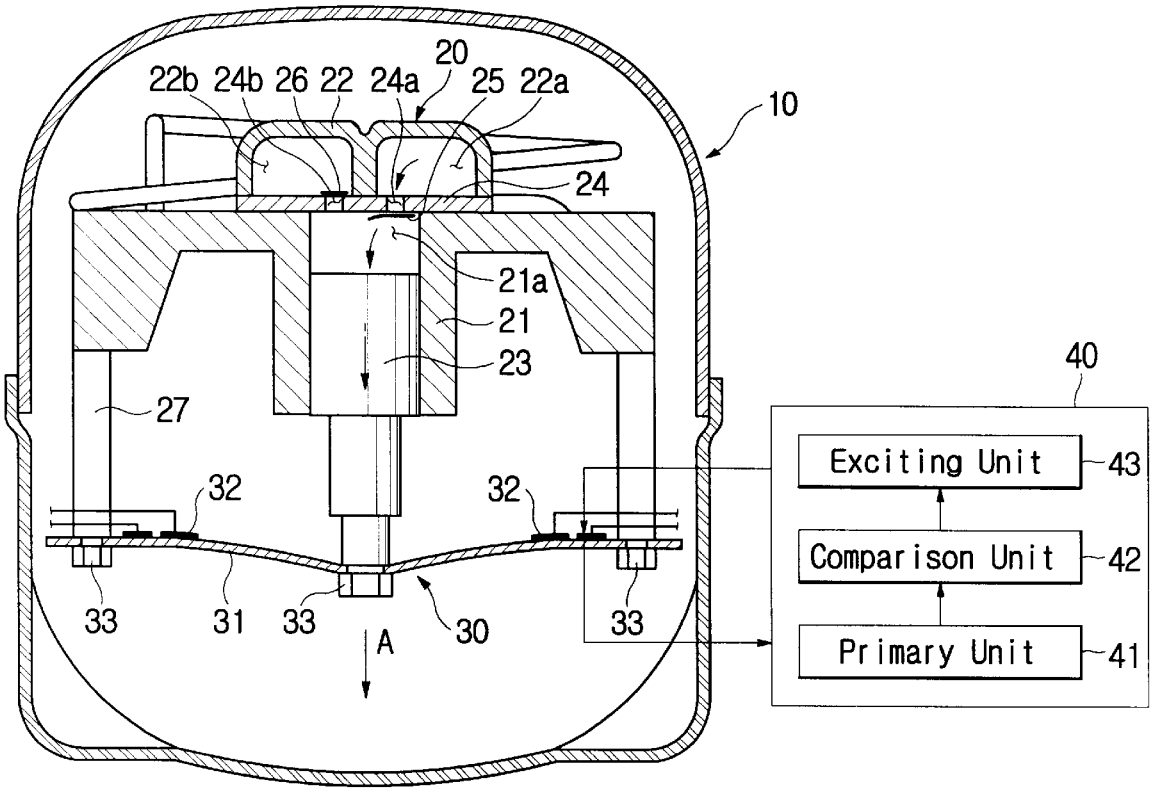
FIGS. 4 and 5 are sectional views showing a driving operation of the compressor shown in FIG. 2.

FIG. 4 shows the controller 40 which controls the operation of the compressor in the airtight container 10. The controller 40 includes a detection unit 41, a comparison unit 42, and an exciting unit 43. The detection unit 41 is electrically connected to the piezoelectric actuators 32, and senses the displacement of the elastic member 31 using the deformations of the piezoelectric actuators 32. The comparison unit 42 compares a displacement value sensed by the detection unit 41 with a preset reference value. The exciting unit 43 controls an electrical energy applied to the piezoelectric actuators 32 according to a comparison result obtained from the comparison unit 42.

Hereinafter, the operation of the compressor of the present invention is described in detail.

In absence of power, FIG. 2 shows that the piezoelectric actuators 32 are not deformed and the elastic member 31 maintains its flat state.

In response to a positive voltage, FIG. 4 shows that the piezoelectric actuators 32 are deformed downward. Accordingly, the center portion 31*c* (FIG. 3) of the elastic member 31 is deformed downward, thereby allowing the piston 23 to move toward its bottom dead center (in a direction indicated by an arrow A of FIG. 4). The piezoelectric actuators 32 are attached to the opposite peripheral portions 31*a* and 31*b* (FIG. 3) of the fixed elastic member 31, such that the movable center portion 31*c* of the elastic member 31 is predominantly moved downward.

Figure 5:
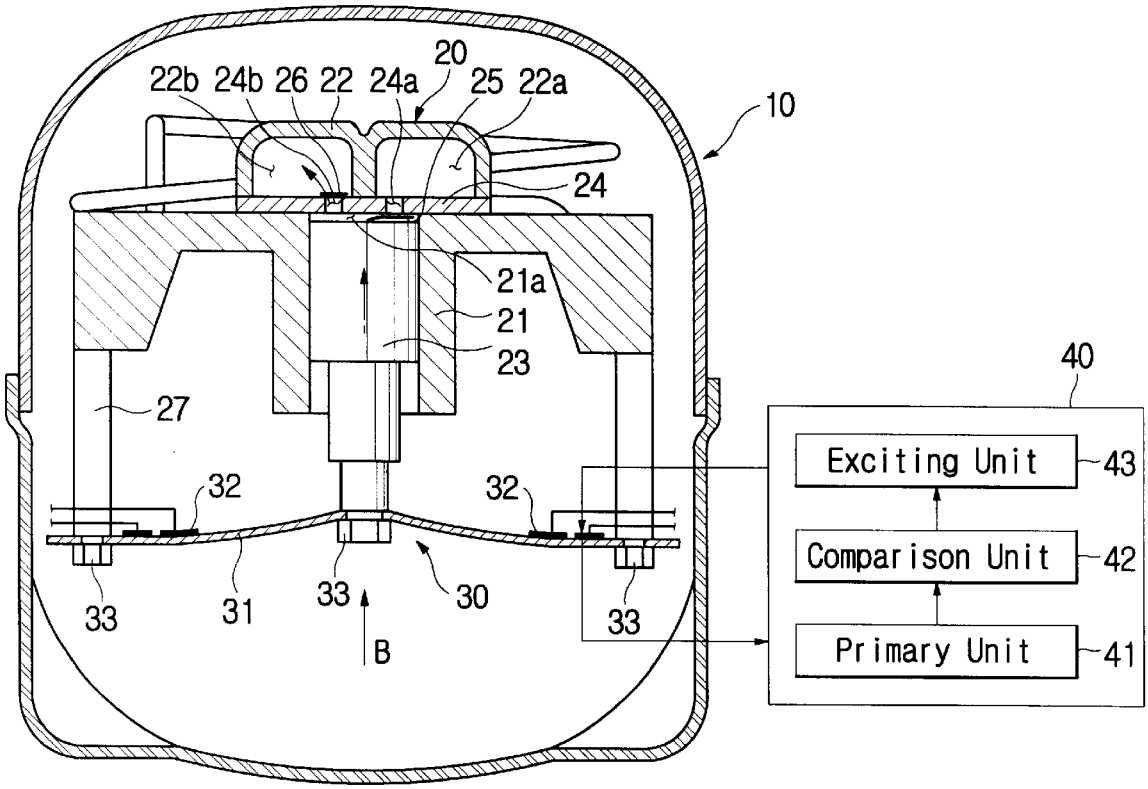

In response to a negative voltage, FIG. 5 shows that the piezoelectric actuators 32 are deformed upward. Therefore, the center portion 31*c* of the elastic member 31 is also deformed upward, thereby allowing the piston 23 to move toward its top dead center (in a direction indicated by an arrow B of FIG. 5).

The controller 40 senses the movement of the piston 23 through the deformations of the piezoelectric actuators 32, and reciprocates the piston 23 up and down by applying a power to the piezoelectric actuators 32 until a desired output is achieved. As a result, the piston 23 is linearly reciprocated up and down through the compression chamber 21*a* by its own weight and an exciting power of the elastic member 31. Accordingly, the refrigerant in the suction chamber 22*a* is sucked into the compression chamber 21 through the suction hole 24*a* to be compressed. Thereafter, the sucked refrigerant is compressed, the compressed refrigerant is discharged to the discharge chamber 22*b* through the discharge hole 24*b*, and the discharged refrigerant is returned to the freezing cycle.

As described above, the reciprocating movement of the piston 23 is provided by one or more of piezoelectric actuators 32 being repeatedly deformed, so as to oscillate the elastic member 31 up and down according to the applied power. Therefore, the deformation of the elastic member 31 can be controlled by adjusting the amount and/or frequency of the power such as an electric voltage applied to the piezoelectric actuators 32. That is, the deformation of the elastic member 31 is varied according to the amount of the electric voltage applied to the piezoelectric actuators 32, thus enabling the displacement of the piston 23 to be easily controlled. In addition, the displacement of the piston 23 can be controlled by varying the frequency of the electric voltage (signal) so as to dynamically vary the applied electric voltage.

According to another embodiment of the present invention, the piezoelectric actuators 32 can be oppositely attached to upper and lower surfaces of the elastic member 31.

According to yet another embodiment of the present invention, a number of piezoelectric actuators can be arranged to be spaced apart from each other throughout an entire surface of the elastic member 31, so as to generate a greater exciting force to the elastic member 31.

Figure 6:
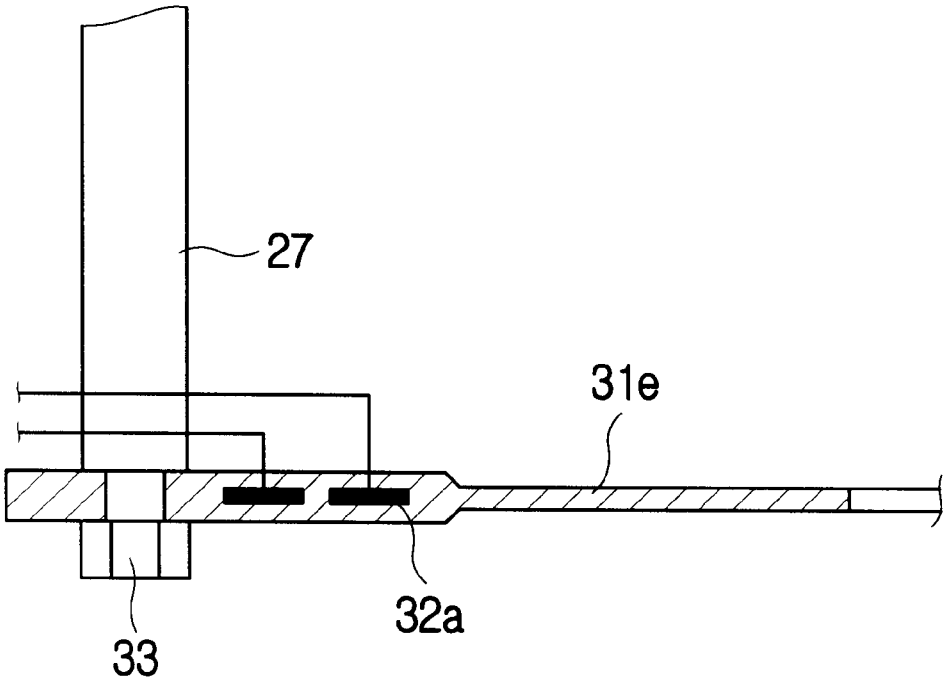
FIG. 6 is a partial sectional view showing an elastic member of the compressor shown in FIG. 2 according to another aspect of the present invention.

FIG. 6 shows still another embodiment of the present invention where one or more piezoelectric actuators 32*a* are contained in an elastic member 31*e* having a predetermined thickness.

Figure 7:
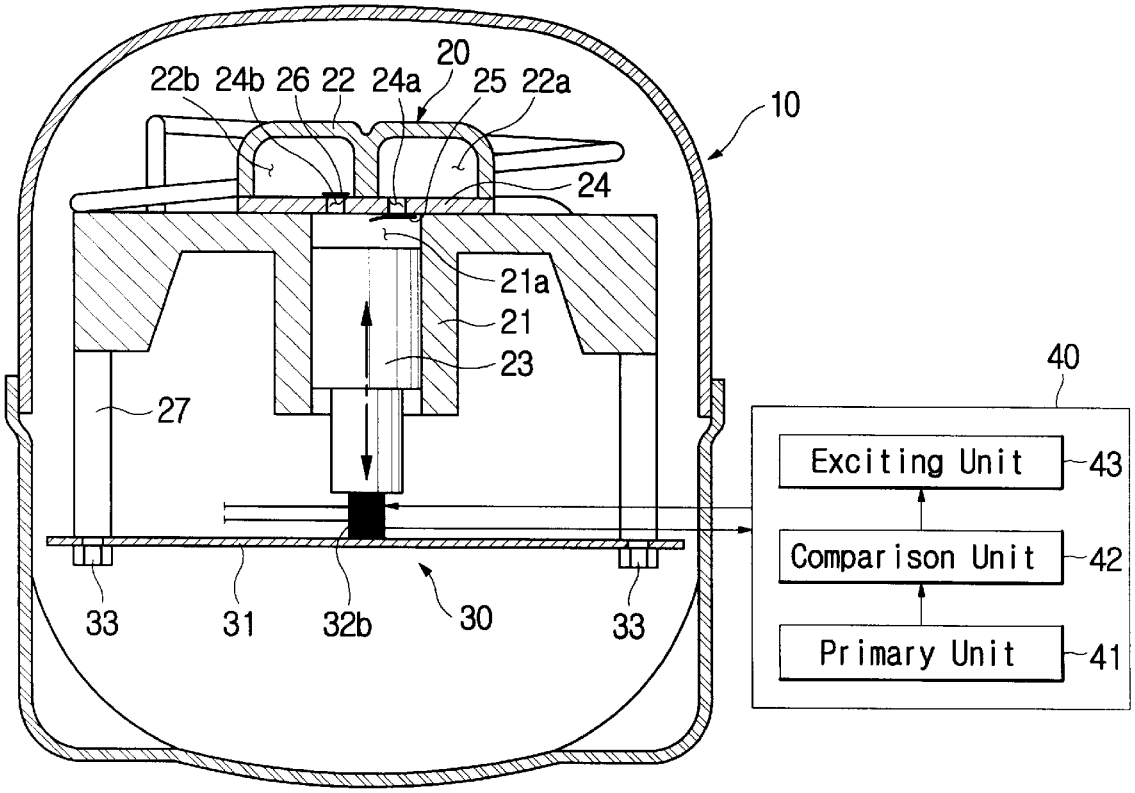
FIG. 7 is a sectional view showing the interior construction of a compressor according to another embodiment of the present invention, FIG. 8 a sectional views showing the interior construction of a compressor according to yet another embodiment of the present invention.

FIG. 7 shows still yet another embodiment of the present invention where one or more piezoelectric actuators 32*b* are positioned between a piston 23 and an elastic member 31 in a layered fashion such that the actuators 32*b* can be expanded and contracted upward and downward. Accordingly, when a power is repeatedly applied to the piezoelectric actuators 32*b*, the actuators 32*b* repeatedly undergo a cycle of expansion and contraction, thus allowing the piston 23 to be linearly reciprocated by the piezoelectric actuators 32*b*. The reciprocating movement of the piston 23 is further increased by the elastic member 31.

Figure 8:
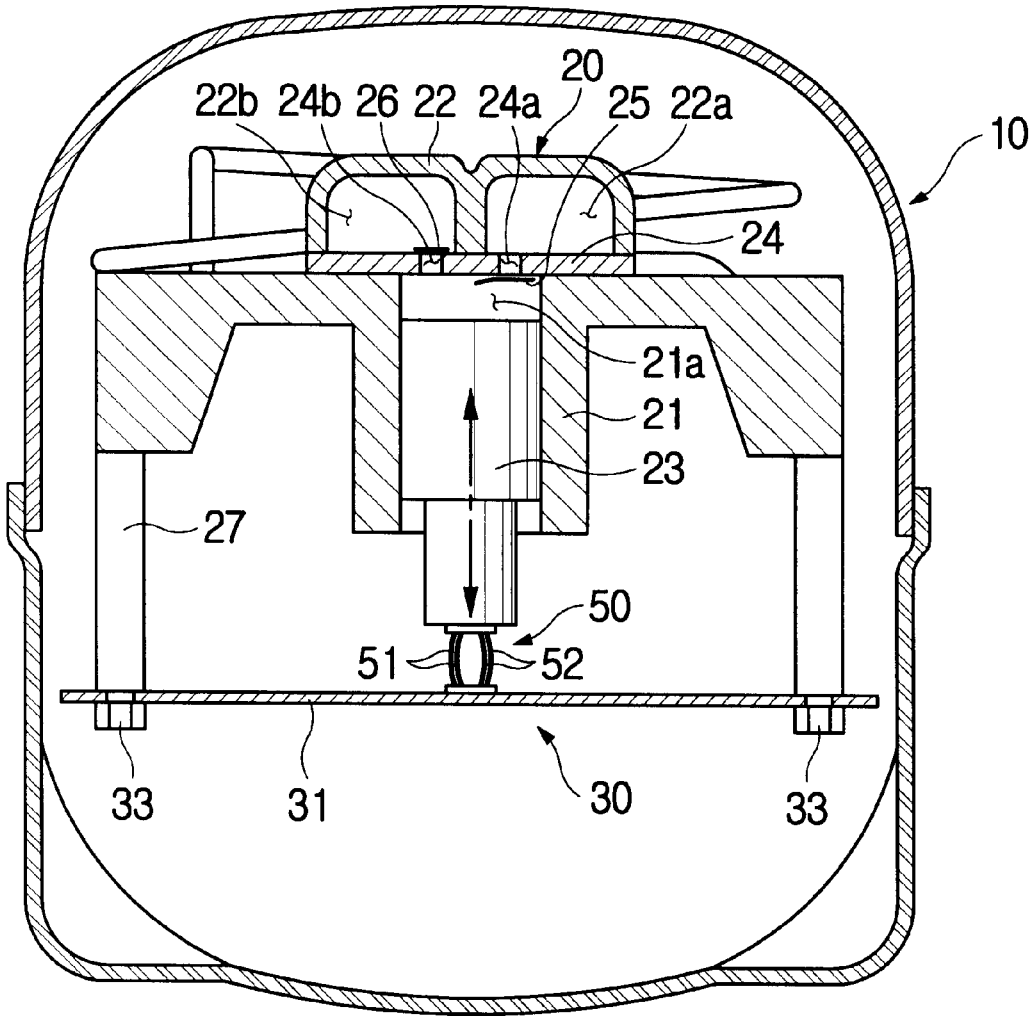

FIG. 8 shows an additional embodiment of the present invention where a piezoelectric actuator 50 is placed between a piston 23 and an elastic member 31. The piezoelectric actuator 50 comprises a first piezoelectric element 51 having its center portion bent in one direction, and a second piezoelectric element 52 having its center portion bent in the opposite direction of the center portion of the first piezoelectric element 51 and arranged symmetrically to the first piezoelectric element 51. That is, the first and second piezoelectric elements 51 and 52 are each formed to be a leaf spring type. One end of each of the first and second piezoelectric elements 51 and 52 is fixed to a center portion of the elastic member 31, and the other end is fixed to an end portion of the piston 23. The first and second piezoelectric elements 51 and 52 are symmetrically arranged so as to not eccentrically operate the piston 23. According to an aspect of this embodiment, the first and second piezoelectric elements 51 and 52 can be arranged to have a multi-fold structure so as to drive the piston 23 with a more powerful force.

Accordingly, as voltage is repeatedly applied to the first and second piezoelectric elements 51 and 52, the first and second piezoelectric elements 51 and 52 repeatedly expand and contract along a vertical distance, while the center portions of the first and second piezoelectric elements 51 and 52 are bent. Therefore, the piston 23 is linearly reciprocated. At this time, the elastic member 31 also oscillates, thus increasing the reciprocating movement of the piston 23.

Figure 9:
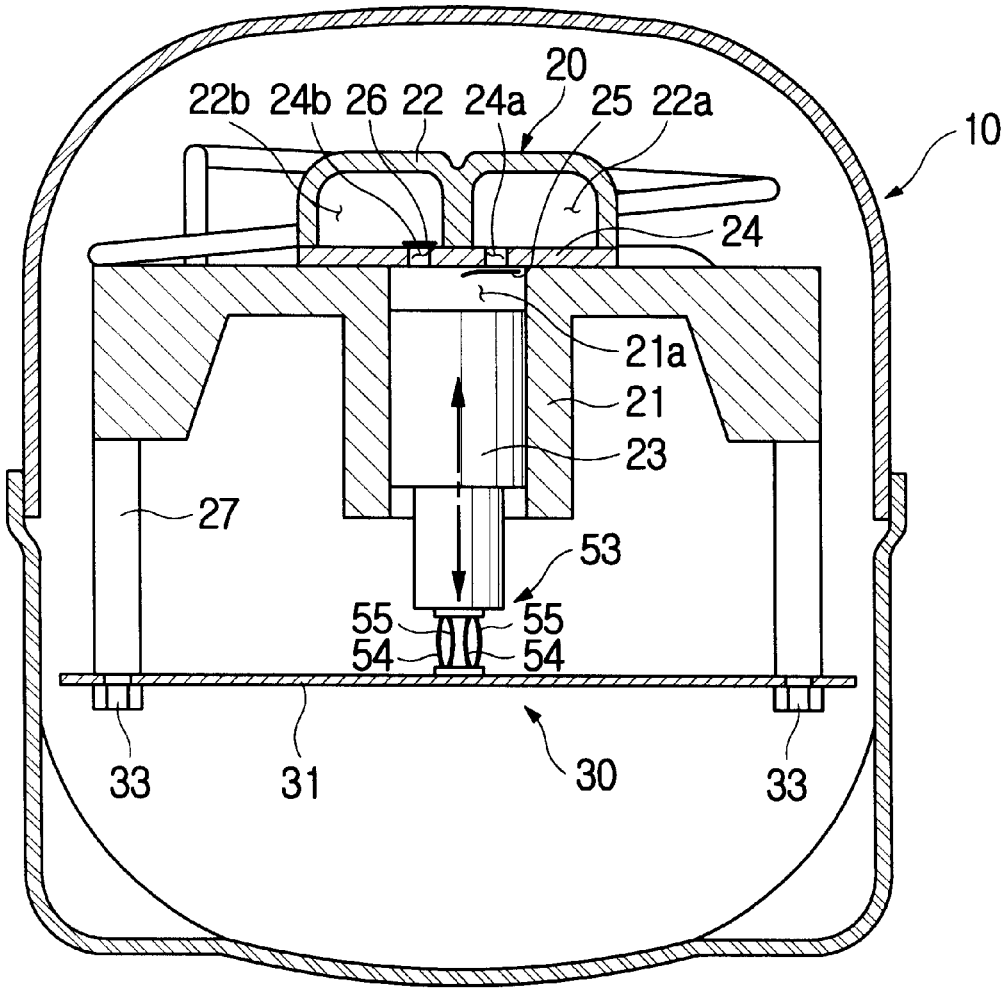
FIG. 9 is a sectional view showing the interior construction of a compressor according to still another embodiment of the present invention.

FIG. 9 shows yet additional another embodiment of the present invention where a piezoelectric actuator 53 comprises first and second piezoelectric elements 54 and 55 which are alternately arranged side by side between a piston 23 and an elastic member 31, wherein center portions of the first piezoelectric elements 54 are bent in the opposite direction of center portions of the second piezoelectric elements 55. Accordingly, the exciting force of the piezoelectric actuator 53 and the elastic member 31 is increased, thus improving the efficiency of a compressor 10.

As described above, the present invention provides a compressor and a method of controlling the compressor. According to an embodiment of the present invention, a driving mechanism which operates a piston includes an elastic member whose peripheral portions are fixed to a cylinder block so as to allow the elastic member to oscillate up and down and whose center portion is attached to a piston, and one or more of piezoelectric actuators arranged on the elastic member which deform and apply an exciting power to the elastic member in response to a power. Accordingly, a driving mechanism of the present invention can be miniaturized to reduce the overall size of the compressor. Furthermore, displacements of the piston can be sensed through the piezoelectric actuators to easily control the desired output of the compressor by controlling a voltage applied to the piezoelectric actuators. Therefore, the present invention does not require additional displacement sensors to sense the displacements of the piston and the elastic member. In addition, a variable-capacity compressor can be realized according to the present invention for desirably varying the capacity of the compressor.

Although a few preferred embodiments of the present invention have been shown and described, it would appreciated be by those skilled in the art that changes may be made in this embodiment without departing from the principles and spirit of the invention, the scope of which is defined in the claims and their equivalents.

What is claimed is:

1. A compressor comprising:

a cylinder block having a compression chamber;

a piston arranged in the compression chamber to be axially reciprocated; and a driving mechanism which drives the piston, comprising:

an elastic member including peripheral portions that are fixed to the cylinder block and a center portion that is attached to the piston, and one or more piezoelectric actuators arranged to the elastic member, which deform and apply an exciting power to oscillate the elastic member in response to a power.

2. The compressor according to claim 1, wherein the cylinder block further comprises one or more fixing members arranged so as to fix the peripheral portions of the elastic member to the one or more fixing members of the cylinder block.

3. The compressor according to claim 1, wherein the one or more piezoelectric actuators comprises one or more piezoelectric elements that are attached to the peripheral portions of the elastic member.

4. The compressor according to claim 1, wherein the one or more piezoelectric actuators comprises one or more piezoelectric ceramics that are attached to the peripheral portions of the elastic member.

5. The compressor according to claim 1, wherein the one or more piezoelectric actuators comprises one or more intelligent type elements that are longitudinally arranged on the elastic member to be spaced apart from each other.

6. The compressor according to claim 5, wherein the one or more intelligent type elements are one or a combination of piezoelectric elements, piezoelectric ceramics and shape memory alloys.

7. The compressor according to claim 1, wherein the one or more piezoelectric actuators comprises one or more intelligent type elements that are positioned between the piston and the elastic member in a layered fashion such that the one or more piezoelectric actuators are axially expanded and contracted.

8. The compressor according to claim 7, wherein the one or more intelligent type elements are one or a combination of piezoelectric elements, piezoelectric ceramics and shape memory alloys.

9. The compressor according to claim 1, wherein the one or more piezoelectric actuators comprises one or more intelligent type elements that are attached to the peripheral portions of the elastic member.

10. The compressor according to claim 9, wherein the one or more intelligent type elements are one or a combination of piezoelectric elements, piezoelectric ceramics and shape memory alloys.

11. The compressor according to claim 1, wherein the one or more piezoelectric actuators comprise one or more intelligent type elements that are formed within the elastic member of a predetermined thickness.

12. The compressor according to claim 11, wherein the one or more intelligent type elements are one or a combination of piezoelectric elements, piezoelectric ceramics and shape memory alloys.

13. The compressor according to claim 1, wherein the one or more piezoelectric actuators comprise one or more intelligent type elements that are oppositely attached to upper and lower surfaces of the elastic member.

14. The compressor according to claim 13, wherein the one or more intelligent type elements are one or a combination of piezoelectric elements, piezoelectric ceramics and shape memory alloys.

15. The compressor according to claim 1, further comprising a control unit which senses a displacement of the elastic member through deformations of the one or more piezoelectric actuators and controls the displacement of the elastic member by adjusting an amount and/or frequency of an electric voltage applied to the one or more piezoelectric actuators as the power.

16. The compressor according to claim 15, wherein the control unit comprises:

a detection unit which is connected to the one or more piezoelectric actuators and senses the displacement of the elastic member through the deformations of the one or more piezoelectric actuators;

a comparison unit which compares a displacement value sensed by the detection unit with a preset reference value; and an exciting unit which controls the electric voltage applied to the one or more piezoelectric actuators according to a comparison result obtained from the comparison unit.

17. A method of controlling a compressor which comprises a cylinder block having a compression chamber, a piston positioned in the compression chamber to be axially reciprocated through the compression chamber, an elastic member including peripheral portions that are fixed to the cylinder block and a center portion that is attached to the piston, and one or more piezoelectric actuators arranged to the elastic member, which deform and apply an exciting power to oscillate the elastic member in response to a power, the method comprising:

sensing a displacement of the elastic member through deformations of the one or more piezoelectric actuators; and controlling the displacement of the elastic member by adjusting an amount and/or frequency of an electric voltage applied as the power to the one or more piezoelectric actuators.

18. The method of claim 17, wherein the sensing of the displacement comprises detecting the displacement using a detection unit connected to the one or more piezoelectric actuators.

19. The method of claim 17, wherein the controlling of the displacement further comprises:

comparing the displacement of the elastic member with a preset reference value; and controlling the amount and/or frequency of the electric voltage in response to the comparing of the displacement with the preset reference value.

20. A controller which controls a compressor having a cylinder block provided with a compression chamber, a piston positioned in the compression chamber to be axially reciprocated through the compression chamber, an elastic member including peripheral portions that are fixed to the cylinder block and a center portion that is attached to the piston, and one or more piezoelectric actuators arranged to the elastic member which deform and apply an exciting power to oscillate the elastic member in response to a power, comprising:

a control unit which senses a movement of the piston through deformations of the one or more piezoelectric actuators and axially reciprocates the piston by applying the power to one or more piezoelectric actuators.

21. The controller of claim 20, wherein the control unit obtains a desired output of the compressor by adjusting an amount and/or frequency of the power applied to the one or more piezoelectric actuators.

22. The controller of claim 20, wherein the control unit comprises:

a detection unit which is connected to the one or more piezoelectric actuators and senses the movement of the piston through the deformations of the one or more piezoelectric actuators;

a comparison unit which compares a displacement value sensed by the detection unit with a preset reference value; and an exciting unit which controls the power applied to the one or more piezoelectric actuators according to a comparison result obtained from the comparison unit.

23. A variable capacity compressor comprising:

a cylinder block having a compression chamber;

a piston arranged in the compression chamber to be axially reciprocated; and an elastic member having one or more piezoelectric actuators, said member being attached to the cylinder block and the piston, and drives the piston in response to a power applied to the one or more piezoelectric actuators of the elastic member.

24. The variable capacity compressor of claim 23, further comprising a controller which adjusts an amount and/or frequency of the power to obtain a desirable output of the variable capacity compressor.

25. A controller for use in a compressor which comprises a cylinder block having a compression chamber, a piston arranged in the compression chamber and an elastic member having one or more piezoelectric actuators, said member being attached to the cylinder block and the piston, and axially drives the piston in response to a power applied to the one or more piezoelectric actuators, comprising:

a sensing unit which senses a displacement of the piston through deformations of the one or more piezoelectric actuators; and an exciting unit which controls the displacement of the piston by adjusting an amount and/or frequency of the power.

26. A method of controlling a compressor which comprises a cylinder block having a compression chamber, a piston positioned in the compression chamber to be axially reciprocated through the compression chamber, an elastic member including peripheral portions that are fixed to the cylinder block and a center portion that is attached to the piston, and one or more piezoelectric actuators arranged to the elastic member which deform and apply an exciting power to oscillate the elastic member in response to a power, the method comprising:

detecting a displacement of the elastic member through deformations of the one or more piezoelectric actuators:

comparing the displacement with a preset reference value; and controlling an electric voltage applied to the one or more piezoelectric actuators as the power in response to the comparing.

27. The method of claim 26, wherein the controlling of the electric voltage comprises adjusting an amount and/or frequency of the electric voltage applied to the one or more piezoelectric actuators.

28. A method of controlling a compressor which comprises a cylinder block having a compression chamber, a piston arranged in the compression chamber and an elastic member having one or more piezoelectric actuators said member being attached to the cylinder block and the piston, and axially drives the piston in response to a power applied to the one or more piezoelectric actuators, the method comprising:

sensing a displacement of the piston through deformations of the one or more piezoelectric actuators; and controlling the displacement of the piston by adjusting an amount and/or frequency of the power.

29. A compressor comprising:

a cylinder block having a compression chamber;

a piston arranged in the compression chamber to be axially reciprocated; and a driving mechanism which drives the piston, comprising:

an elastic member including peripheral portions that are fixed to the cylinder block and a center portion that is attached to the piston, and a piezoelectric actuator including one end which is fixed to a center portion of the elastic member and the other end which is fixed to the piston, wherein the piezoelectric actuator deforms and applies an exciting power to oscillate the elastic member in response to a power.

30. The compressor according to claim 29, wherein the piezoelectric actuator includes a first leaf spring type piezoelectric element having a center portion bent in one direction.

31. The compressor according to claim 30, wherein the piezoelectric actuator further includes a second leaf spring type piezoelectric element having a center portion bent in the opposite direction of the center portion of the first leaf spring type piezoelectric element, wherein the second leaf spring type piezoelectric element is arranged symmetrically to the first leaf spring type piezoelectric element.

32. The compressor according to claim 31, wherein each of the first and second leaf spring type piezoelectric elements comprises a multi-fold structure.

33. The compressor according to claim 31, wherein the piezoelectric actuator further includes a third leaf spring type piezoelectric element having a center portion bent in the same direction of the center portion of the first leaf spring type piezoelectric element, and a fourth leaf spring type piezoelectric element having a center portion bent in the same direction of the center portion of the second leaf spring type piezoelectric element, wherein the third and fourth leaf spring type piezoelectric elements are arranged symmetrically to the first and second leaf spring type piezoelectric elements.

34. The compressor according to claim 33, wherein the first and third leaf spring type piezoelectric elements are arranged side by side to each other, and the second and fourth leaf spring type piezoelectric elements are arranged side by side to each other.

35. The compressor according to claim 33, wherein each of the first, second, third and fourth leaf spring type piezoelectric elements comprises a multi-fold structure.

36. The compressor according to claim 31, wherein the piezoelectric actuator further includes a third leaf spring type piezoelectric element having a center portion bent in the opposite direction of the center portion of the first leaf spring type piezoelectric element, and a fourth leaf spring type piezoelectric element having a center portion bent in the opposite direction of the center portion of the second leaf spring type piezoelectric element, wherein the third and fourth leaf spring type piezoelectric elements are arranged symmetrically to the first and second leaf spring type piezoelectric elements.

37. The compressor according to claim 36, wherein the first and third leaf spring type piezoelectric elements are arranged side by side to each other, and the second and fourth leaf spring type piezoelectric elements are arranged side by side to each other.

38. The compressor according to claim 36, wherein each of the first, second, third and fourth leaf spring type piezoelectric elements comprises a multi-fold structure.

* * * * *